US009148933B2

(12) United States Patent
Ge

(10) Patent No.: US 9,148,933 B2
(45) Date of Patent: Sep. 29, 2015

(54) POWER SUPPLY CIRCUIT FOR MULTI-PATH LIGHT-EMITTING DIODE (LED) LOADS

(75) Inventor: Liang'an Ge, Zhejiang (CN)

(73) Assignee: INVENTRONICS (HANGZHOU), INC., Hangzhou, Zhejiang (CN)

( * ) Notice: Subject to any disclaimer, the term of this patent is extended or adjusted under 35 U.S.C. 154(b) by 332 days.

(21) Appl. No.: 13/813,723

(22) PCT Filed: Dec. 16, 2010

(86) PCT No.: PCT/CN2010/079857

§ 371 (c)(1),
(2), (4) Date: Feb. 1, 2013

(87) PCT Pub. No.: WO2012/016410

PCT Pub. Date: Feb. 9, 2012

(65) Prior Publication Data

US 2013/0127343 A1 May 23, 2013

(30) Foreign Application Priority Data

Aug. 3, 2010 (CN) ..... 2010 1 0246507

(51) Int. Cl.
*H05B 41/00* (2006.01)
*H05B 37/02* (2006.01)
*H05B 33/08* (2006.01)

(52) U.S. Cl.
CPC ..... *H05B 37/02* (2013.01); *H05B 33/0815* (2013.01); *H05B 33/0887* (2013.01)

(58) Field of Classification Search
CPC ..... H05B 37/00; H05B 37/03; H05B 41/00; H05B 33/0815; H05B 33/0818; H05B 33/0857; H05B 33/08; H05B 33/0824; H05B 41/282; H05B 33/0803; H05B 33/0809; H05B 33/0812; H05B 33/0827; H05B 33/083; H05B 33/0842; H05B 33/0845; H05B 33/0851
USPC ..... 315/160, 172, 176
See application file for complete search history.

(56) References Cited

U.S. PATENT DOCUMENTS 4,996,462 A 2/1991 Krummel
6,441,558 B1 * 8/2002 Muthu et al. ..... 315/149

(Continued)

FOREIGN PATENT DOCUMENTS

CN 101702854 A 5/2010
CN 101772246 A 7/2010
CN 101778506 A 7/2010
CN 201766749 U 3/2011

(Continued)

OTHER PUBLICATIONS

International Search Report (in Chinese with English translation) and Written Opinion (in Chinese) for PCT/CN2011/079857, mailed May 12, 2011.

*Primary Examiner* — Hai L Nguyen
(74) *Attorney, Agent, or Firm* — Harness, Dickey & Pierce, P.L.C.

(57) ABSTRACT

The present invention discloses a power supply circuit for multi-path light-emitting diode (LED) loads. The two ports of the second diode are connected in parallel with the first switch tube, and the two ports of the forth diode are connected in parallel with the second switch tube. The conduction mode of the second and forth diodes is controlled by controlling the switch status of the first and second switch tubes. When the system is on a normal state, the first and second switch tubes are both switched off. When the load output of any path needs to be turned off, the corresponding switch tube should be controlled to switch on, which makes the diode connected in parallel with the switch tube short-circuited. The present invention can avoid a strong impulse current produced in filtering capacitor when the load of any path is directly short-circuited. Therefore, the present invention can reduce the current stress in circuits, improve the reliability of circuits, and reduce the cost.

12 Claims, 9 Drawing Sheets

(56) References Cited

U.S. PATENT DOCUMENTS

| | | | | |
|---|---|---|---|---|
| 7,129,652 | B2 | 10/2006 | Patel et al. | |
| 8,872,430 | B2 * | 10/2014 | Yang | 315/122 |
| 2012/0286678 | A1 | 11/2012 | Wu et al. | |

FOREIGN PATENT DOCUMENTS

| | | | |
|---|---|---|---|
| CN | 102348310 | B | 8/2013 |
| KR | 20100049243 | A | 5/2010 |
| WO | WO 2011079701 | A1 | 7/2011 |

* cited by examiner

POWER SUPPLY CIRCUIT FOR MULTI-PATH LIGHT-EMITTING DIODE (LED) LOADS

CROSS REFERENCE TO RELATED APPLICATION

The present application is a 371 National Stage of International Application No. PCT/CN2010/079857, titled "POWER SUPPLY CIRCUIT FOR MULTI-PATH LIGHT-EMITTING DIODE (LED) LOADS", filed on Dec. 16, 2010, which claims the priority to Chinese patent application No. 201010246507.7, entitled "POWER SUPPLY CIRCUIT FOR MULTI-PATH LIGHT-EMITTING DIODE (LED) LOADS", filed with the State Intellectual Property Office of PRC on Aug. 3, 2010, which are incorporated herein by reference in their entirety.

FIELD OF THE INVENTION

The present invention relates to the technical field of power electronics, and more particularly to a power supply circuit for multiple LED loads.

BACKGROUND OF THE INVENTION

A constant current driver circuit for two LED loads (Chinese patent application No. 200910155848.0) is shown in FIG. 1, in which a capacitor Cb can maintain the currents of two LED loads (A1 and A2) to be equal. In FIG. 1 the constant current driver circuit for only two LED loads is shown. A constant current driver circuit for more than two LED loads can be implemented as the circuits shown in FIG. 2 and FIG. 3, in which current sharing among multiple LED loads is achieved by a current sharing transformer T1. The circuit in FIG. 2 is applicable to drive even number of LED loads, and the circuit in FIG. 3 is applicable to drive odd number of LED loads.

In the circuit shown in FIG. 1, if one of the LED loads is opened and the other path of the LED loads is ensured to operate normally, an abnormal overvoltage will occur at the output of the opened load, such that the driver circuit will be damaged. Therefore, an additional open circuit protection circuit is needed.

An LED driver circuit with an open circuit protection circuit in the prior art is shown in FIG. 4.

Each of the LED loads is connected in parallel to an open circuit protection circuit K. When an abnormal overvoltage is detected at the output, a thyristor (SCR1, SCR2) is turned on and a load current flows through the thyristor, so as to avoid the abnormal output voltage due to the open circuit of the load.

However, the open circuit protection circuit K has the following disadvantages: when the output voltage is abnormal, the thyristor is turned on, and short-circuit discharge of an output filter capacitor (Co3, Co4) will cause a large impulse current, such that current stress in the circuit is increased, the cost of the circuit is increased and the reliability of the circuit is reduced.

SUMMARY OF THE INVENTION

An object of the invention is to provide a power supply circuit for multiple LED loads, so as to reduce current stress in the circuit and reduce the cost of the circuit.

It is provided a power supply circuit for multiple LED loads according to the invention, and the power supply circuit for multiple LED loads includes a first filter capacitor, a second filter capacitor, a first switch tube, a second switch tube, a first rectifier branch and a second rectifier branch;

inputs of the first rectifier branch and inputs of the second rectifier branch are connected to a high-frequency AC (alternating current) power source;

a first input of the first rectifier branch, a first diode, a first LED load, a fourth diode and a first capacitor are sequentially connected in series to a second input of the first rectifier branch;

a second input of the second rectifier branch, the first capacitor, a third diode, a second LED load and a second diode are sequentially connected in series to a first input of the second rectifier branch;

the first input of the first rectifier branch is connected to the first input of the second rectifier branch, and the second input of the first rectifier branch is connected to the second input of the second rectifier branch;

the first filter capacitor is connected in parallel to the first LED load, and the second filter capacitor is connected in parallel to the second LED load;

the first switch tube is connected in parallel to the second diode, and when the first LED load needs to be turned off, the first switch tube is switched on; and the second switch tube is connected in parallel to the fourth diode, and when the second LED load needs to be turned off, the second switch tube is switched on.

Preferably, the power supply circuit for multiple LED loads further includes a first control circuit and a second control circuit;

the first control circuit is configured to detect an output voltage of the first LED load, and switch on the first switch tube when the output voltage of the first LED load is higher than a first preset voltage; and the second control circuit is configured to detect an output voltage of the second LED load, and switch on the second switch tube when the output voltage of the second LED load is higher than a second preset voltage.

Preferably, the first control circuit is a first comparator, and the second control circuit is a second comparator;

a positive input of the first comparator is connected to a positive output of the first LED load, a negative input of the first comparator is connected to the first preset voltage, and an output of the first comparator is connected to a control terminal of the first switch tube; and a positive input of the second comparator is connected to a positive output of the second LED load, a negative input of the second comparator is connected to the second preset voltage, and an output of the second comparator is connected to a control terminal of the second switch tube.

It is further provided a power supply circuit for multiple LED loads according to the invention, and the power supply circuit for multiple LED loads includes: a first filter capacitor, a second filter capacitor, a first rectifier branch and a second rectifier branch;

inputs of the first rectifier branch and inputs of the second rectifier branch are connected to a high-frequency AC power source;

a first input of the first rectifier branch, a first diode, a first LED load, a second switch tube and a first capacitor are sequentially connected in series to a second input of the first rectifier branch;

a second input of the second rectifier branch, the first capacitor, a second diode, a second LED load, and a first switch tube are sequentially connected in series to a second input of the second rectifier branch;

the first input of the first rectifier branch is connected to the first input of the second rectifier branch, and the second input of the first rectifier branch is connected to the second input of the second rectifier branch;

in the case that the power supply circuit is in a normal state, when the high-frequency AC power source outputs a positive voltage, the first diode and the second switch tube are switched on to supply power to the first LED load; and when the high-frequency AC power source outputs a negative voltage, the first switch tube and the second diode are turned on to supply power to the second LED load; and when the first LED load needs to be turned off, the first switch tube is switched on when the high-frequency AC power source outputs a positive voltage or a negative voltage; and when the second LED load needs to be turned off, the second switch tube is switched on when the high-frequency AC power source outputs a positive voltage or a negative voltage.

Preferably, the power supply circuit for multiple LED loads further includes a first switch tube driver circuit, a second switch tube driver circuit, a first control circuit and a second control circuit;

the first switch tube driver circuit includes a first enable circuit, a third diode and a first synchronous rectifier control circuit; an output of the first control circuit is connected to a control terminal of the first switch tube via the third diode; the output of the first control circuit is connected to a first input of the first synchronous rectifier control circuit via the first enable circuit, a second input and a third input of the first synchronous rectifier control circuit are connected to other two terminals of the first switch tube respectively, and an output of the first synchronous rectifier control circuit is connected to the control terminal of the first switch tube; and when the first LED load needs to be turned off, the first control circuit outputs a high level to turn on the third diode, and meanwhile controls the first enable circuit to output an enable signal for stopping the first synchronous rectifier control circuit outputting a driving signal, so as to switch on the first switch tube;

the second switch tube driver circuit includes a second enable circuit, a fourth diode, and a second synchronous rectifier control circuit; an output of the second control circuit is connected to a control terminal of the second switch tube via the fourth diode; the output of the second control circuit is connected to a first input of the second synchronous rectifier control circuit via the second enable circuit, a second input and a third input of the second synchronous rectifier control circuit are connected to other two terminals of the second switch tube respectively, and an output of the second synchronous rectifier control circuit is connected to the control terminal of the second switch tube; and when the second LED load needs to be turned off, the second control circuit outputs a high level to turn on the fourth diode, and meanwhile controls the second enable circuit to output an enable signal for stopping the second synchronous rectifier control circuit outputting a driving signal, so as to switch on the second switch tube.

Preferably, the power supply circuit for multiple LED loads further includes a first switch tube driver circuit, a second switch tube driver circuit, a first control circuit and a second control circuit;

the first switch tube driver circuit includes a third diode, a first current transformer, a first shaping reset circuit, a third triode, a fourth triode and a first driver self-powered circuit; a primary winding of the first current transformer is connected between the first diode and the first switch tube, two terminals of a secondary winding of the first current transformer are respectively connected to two inputs of the first shaping reset circuit, and the two terminals of the secondary winding of the first current transformer are further respectively connected to two inputs of the first driver self-powered circuit; the third triode and the fourth triode are connected to form a push-pull circuit, an output of the first shaping reset circuit is connected to an input of the push-pull circuit, and an output of the push-pull circuit is connected to a control terminal of the first switch tube; an output of the first driver self-powered circuit is connected to a collector of the third triode; a collector of the fourth triode is grounded; an output of the first control circuit is connected to the input of the push-pull circuit via the third diode; and when the first LED load needs to be turned off, the first control circuit outputs a high level to turn on the third diode, and the push-pull circuit outputs a high level to switch on the first switch tube; and the second switch tube driver circuit includes a fourth diode, a second current transformer, a second shaping reset circuit, a fifth triode, a sixth triode, and a second driver self-powered circuit; a primary winding of the second current transformer is connected between the second diode and the second switch tube, two terminals of a secondary winding of the second current transformer are respectively connected to two inputs of the second shaping reset circuit, and the two terminals of the secondary winding of the second current transformer are further respectively connected to two inputs of the second driver self-powered circuit; the fifth triode and the sixth triode are connected to form a push-pull circuit, an output of the second shaping reset circuit is connected to an input of the push-pull circuit, and an output of the push-pull circuit is connected to a control terminal of the second switch tube; an output of the second driver self-powered circuit is connected to a collector of the fifth triode; a collector of sixth triode is grounded; an output of the first control circuit is connected to the input of the push-pull circuit via the third diode; and when the second LED load needs to be turned off, the second control circuit outputs a high level to turn on the fourth diode, and the push-pull circuit outputs a high level to switch on the second switch tube.

Preferably, the power supply circuit for multiple LED loads further includes a first switch tube driver circuit, a second switch tube driver circuit, a first control circuit and a second control circuit;

the first switch tube driver circuit includes a third diode, a first auxiliary winding and a third switch tube; an output of the first control circuit is connected to a control terminal of the third switch tube via the third diode; one of other two terminals of the third switch tube is connected to a control terminal of the first switch tube, the other one of the other two terminals of the third switch tube is connected to one terminal of the first auxiliary winding, and the other terminal of the first auxiliary winding is grounded; and when the first LED load needs to be turned off, the first control circuit outputs a low level to cut off the third diode and the third switch tube and switch on the first switch tube; and the second switch tube driver circuit includes a fourth diode, a second auxiliary winding and a fourth switch tube; an output of the second control circuit is connected to a control terminal of the fourth switch tube via the fourth diode; one of other two terminals of the fourth switch tube is connected to a control terminal of the second switch tube, the other one of the other two terminals of the fourth switch tube is connected to one terminal of the second auxiliary winding, and the other terminal of the second auxiliary winding is grounded; and when the second LED load needs to be turned off, the second control circuit outputs a low level to cut off the fourth diode and the fourth switch tube and switch on the second switch tube.

Preferably, the first control circuit is configured to detect an output voltage of the first LED load, and switch on the first switch tube when the output voltage of the first LED load is higher than a first preset voltage; and the second control circuit is configured to detect an output voltage of the second LED load, and switch on the second switch tube when the output voltage of the second LED load is higher than a second preset voltage.

Preferably, the first control circuit is a first comparator, and the second control circuit is a second comparator;

a positive input of the first comparator is connected to a positive output of the first LED load, a negative input of the first comparator is connected to the first preset voltage, and an output of the comparator is connected to an anode of the third diode; and a positive input of the second comparator is connected to a positive output of the second LED load, a negative input of the second comparator is connected to the second preset voltage, and an output of the second comparator is connected to an anode of the fourth diode.

Preferably, a main circuit of the power supply circuit is a LLC resonant converter circuit, a bridge circuit, an active clamp flyback circuit or a forward flyback circuit.

The invention has the following advantages over the prior art:

In the power supply circuit for multiple LED loads according to the embodiments of the invention, the first switch tube is connected in parallel to the second diode, and the second switch tube is connected in parallel to the fourth diode; the on states of the second diode and the fourth diode are controlled by controlling the on/off-states of the first switch tube and the second switch tube. When the system is in a normal state, the first switch tube and the second switch tube are both switched off; and when one of loads needs to be turned off, a corresponding switch tube is switched on such that the diode connected in parallel to the corresponding switch tube is shorted. Thus, strong impulse current in filter capacitor due to the direct short of any of the loads is avoided, such that the current stress in the circuit is reduced, the reliability of the circuit is improved, and the cost of the circuit is reduced.

DETAILED DESCRIPTION OF THE INVENTION

In order to make the above-mentioned object, features and advantages of the invention more apparent and understandable, in the following the embodiments of the invention will be described in detail in conjunction with the accompanying drawings.

Figure 5:
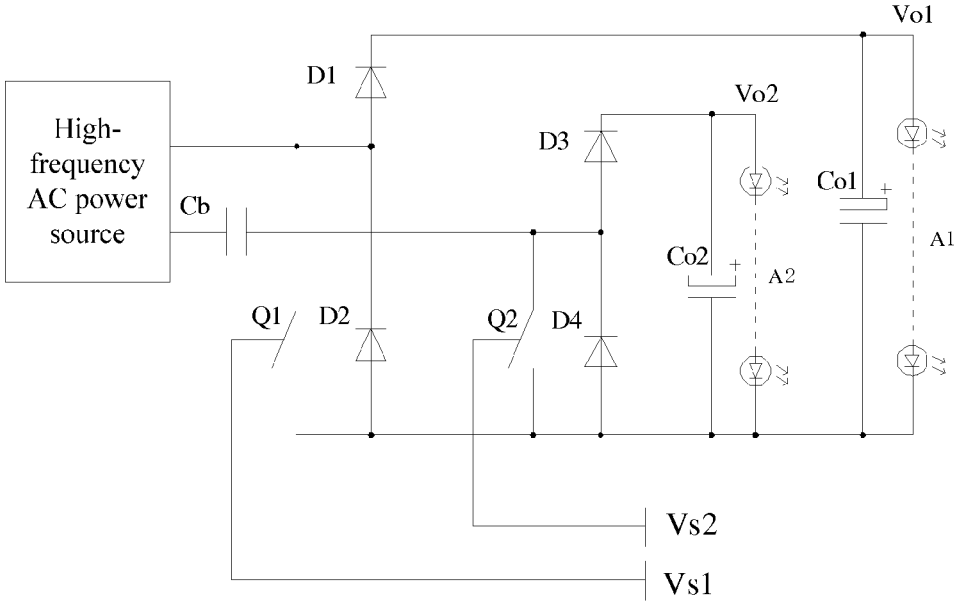
FIG. 5 is a circuit diagram of a power supply circuit for multiple LED loads according to a first embodiment of the invention.

A circuit diagram of a power supply circuit for multiple LED loads according to a first embodiment of the invention is shown in FIG. 5.

The power supply circuit for multiple LED loads according to this embodiment includes: a first filter capacitor Co1, a second filter capacitor Co2, a first switch tube Q1, a second switch tube Q2, a first rectifier branch and a second rectifier branch;

inputs of the first rectifier branch and inputs of the second rectifier branch are connected to a high-frequency AC power source; as shown in FIG. 5, an anode of a first diode D1 and a cathode of a second diode D2 are both connected to one terminal of the high-frequency AC power source, and a left terminal of a first capacitor Cb is connected to the other terminal of the high-frequency AC power source. It is to be noted that in each of the following embodiments the first rectifier branch and the second rectifier branch connect to the high-frequency AC power source in a way identical to that in this embodiment, and the description thereof is omitted.

A first input of the first rectifier branch, the first diode D1, a first LED load A1, a fourth diode D4 and the first capacitor Cb are sequentially connected in series to a second input of the first rectifier branch.

A second input of the second rectifier branch, the first capacitor Cb, a third diode D3, a second LED load A2 and the second diode D2 are sequentially connected in series to a first input of the second rectifier branch.

The first input of the first rectifier branch is connected to the first input of the second rectifier branch, and the second input of the first rectifier branch is connected to the second input of the second rectifier branch.

The first filter capacitor Co1 is connected in parallel to the first LED load A1, and the second filter capacitor Co2 is connected in parallel to the second LED load A2.

The first switch tube Q1 is connected in parallel to the second diode D2, and is switched on when the first LED load A1 needs to be turned off.

The second switch tube Q2 is connected in parallel to the fourth diode D4, and is switched on when the second LED load A2 needs to be turned off.

The high-frequency AC power source supplies power to the first LED load A1 and the second LED load A2, and the high frequency mentioned in the term "the high-frequency AC power supply" is higher than tens of KHz.

It is to be noted that the on/off-states of the first switch tube Q1 and the second switch tube Q2 can be controlled by a first control signal Vs1 and a second control signal Vs2 respectively.

In the power supply circuit for multiple LED loads according to the embodiment of the invention, the first switch tube Q1 is connected in parallel to the second diode D2, and the second switch tube Q2 is connected in parallel to the fourth diode D4; the on states of the second diode D2 and the fourth diode D4 are controlled by controlling the on/off-states of the first switch tube Q1 and the second switch tube Q2. When the system is in a normal state, as the high-frequency AC power supply outputs a positive voltage and a negative voltage alternatively, the first rectifier branch and the second rectifier branch operate alternatively, and the first switch tube Q1 and the second switch tube Q2 are both switched off; when one of the loads needs to be turned off, a corresponding switch tube is switched on such that the diode connected in parallel to the corresponding switch tube is shorted. Thus, a large impulse current in the filter capacitor due to the direct short of any of the loads is avoided, such that the current stress in the circuit is reduced, the reliability of the circuit is improved, and the cost of the circuit is reduced.

Figure 6:
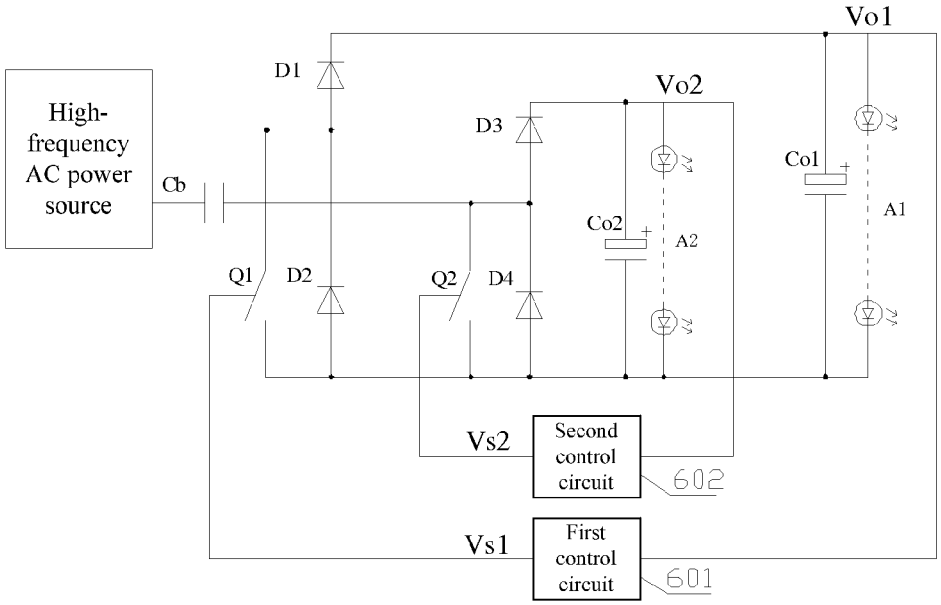
FIG. 6 is a circuit diagram of a power supply circuit for multiple LED loads according to a second embodiment of the invention.

A circuit diagram of a power supply circuit for multiple LED loads according to a second embodiment of the invention is shown in FIG. 6.

The power supply circuit for multiple LED loads according to this embodiment further includes a first control circuit 601 and a second control circuit 602.

An input of the first control circuit 601 is connected to an output of the first LED load A1, and an output of the first control circuit 601 is connected to a control terminal of the first switch tube Q1.

The first control circuit 601 is configured to detect an output voltage of the first LED load A1, and switch on the first switch tube Q1 when the output voltage of the first LED load A1 is higher than a first preset voltage.

An input of the second control circuit 602 is connected to a positive output of the second LED load A2, and an output of the second control circuit 602 is connected to a control terminal of the second switch tube Q2.

The second control circuit 602 is configured to detect an output voltage of the second LED load A2, and switch on the second switch tube Q2 when the output voltage of the second LED load A2 is higher than a second preset voltage.

In the power supply circuit for multiple LED loads according to this embodiment, the on/off-states of the first switch tube Q1 and the second switch tube Q2 can be controlled by detecting the output voltages of the LED loads. When a failure such as an open circuit or an overvoltage occurs in one of the LED loads, the LED load with the failure is turned off to prevent an abnormal overvoltage from occurring in the LED load. Additionally, a self-locking circuit can be added to maintain a corresponding switch tube in the on-state after the load with the failure is turned off.

Figure 7:
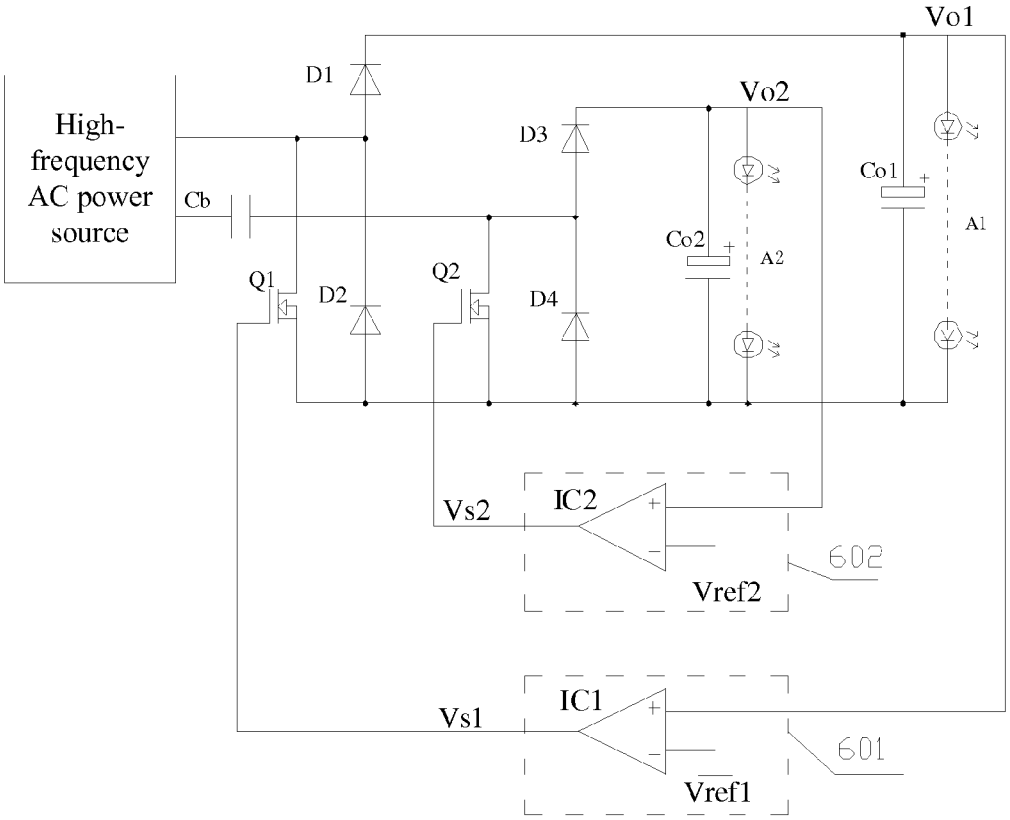
FIG. 7 is a circuit diagram of a power supply circuit for multiple LED loads according to a third embodiment of the invention.

It is to be noted that in this embodiment of the invention, the first control circuit 601 is a first comparator IC1, and the second control circuit 602 is a second comparator IC2, as shown in FIG. 7, which is a circuit diagram of a power supply circuit for multiple LED loads according to a third embodiment of the invention.

A positive input of the first comparator IC1 is connected to a positive output of the first LED load A1, a negative input of the first comparator IC1 is connected to the first preset voltage Vref1, and an output of the first comparator IC1 is connected to the a control terminal of the first switch tube Q1; and a positive input of the second comparator IC2 is connected to a positive output of the second LED load A2, a negative input of the second comparator IC2 is connected to the second preset voltage Vref2, and an output of the second comparator IC2 is connected to a control terminal of the second switch tube Q2.

It is to be noted that the first preset voltage Vref1 and the second preset voltage Vref2 may be or may be not the same.

For the power supply circuits for multiple LED loads according to the above embodiments, the rectifier branches include four diodes. In the invention, it is further provided a power supply circuit for multiple LED loads in which a rectifier loop includes two diodes and two switch tubes, and the two switch tubes may each serve as a synchronous rectifier tube when the circuit is in a normal state and as a switch tube when the circuit is in a failed state. Another power supply circuit for multiple LED loads according to the invention will be described in detail in conjunction with the accompanying drawings below.

Figure 8:
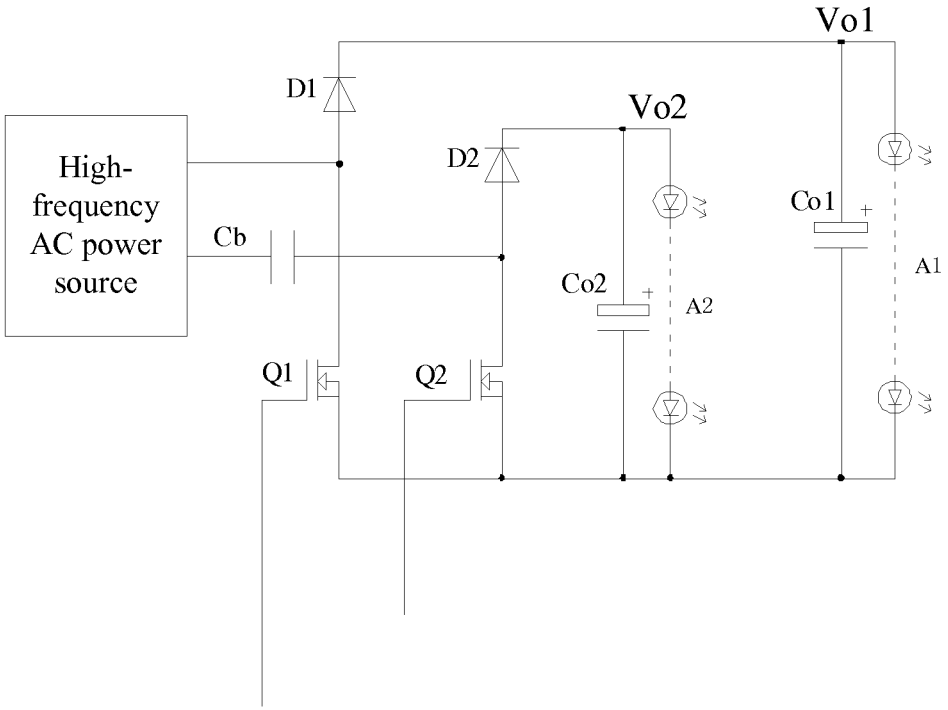
FIG. 8 is a circuit diagram of a power supply circuit for multiple LED loads according to a fourth embodiment of the invention.

A power supply circuit for multiple LED loads according to a fourth embodiment of the invention is shown in FIG. 8.

The power supply circuit for multiple LED loads according to this embodiment includes a first filter capacitor Co1, a second filter capacitor Co2, a first rectifier branch and a second rectifier branch;

inputs of the first rectifier branch and inputs of the second rectifier branch are connected to a high-frequency AC power source;

a first input of the first rectifier branch, a first diode, a first LED load, a second switch tube and a first capacitor are sequentially connected in series to a second input of the first rectifier branch;

an second input of the second rectifier branch, the first capacitor, a second diode, a second LED load and a first switch tube are sequentially connected in series to the first input of the second rectifier branch;

the first input of the first rectifier branch is connected to the first input of the second rectifier branch, and the second input of the first rectifier branch is connected to the second input of the second rectifier branch;

in the case that the power supply circuit is in a normal state, when the high-frequency AC power source outputs a positive voltage, the first diode D1 and the second switch tube Q2 are turned on to supply power to the first LED load A1; and when the high-frequency AC power source outputs a negative voltage, the first switch tube Q1 and the second diode D2 are turned on to supply power to the second LED load A2; and when the first LED load A1 needs to be turned off, the first switch tube Q1 is switched on when the high-frequency AC power source outputs a positive voltage or a negative voltage; and when the second LED load A2 needs to be turned off, the second switch tube Q2 is switched on when the high-frequency AC power source outputs a positive voltage or a negative voltage.

In the power supply circuit for multiple LED loads according to this embodiment, when the system is in a normal state, a rectifier loop is formed by the first diode D1, the second diode D2, the first switch tube Q1 and the second switch tube Q2 which serve as diodes; and when one of the LED loads needs to be turned off, the switch tube in the rectifier branch which corresponds to this LED load is maintained in the on-state, and at this time, the switch tube serves as not only a diode but also a controllable switch tube. Similarly, with the power supply circuit according to this embodiment, the strong impulse current due to the direct short of any LED load is avoided, the reliability of the circuit is improved, and the cost of the circuit is reduced. In additional, a self-locking circuit can be added to maintain the corresponding switch tube in the on-state after the failed load is turned off.

Figure 9:
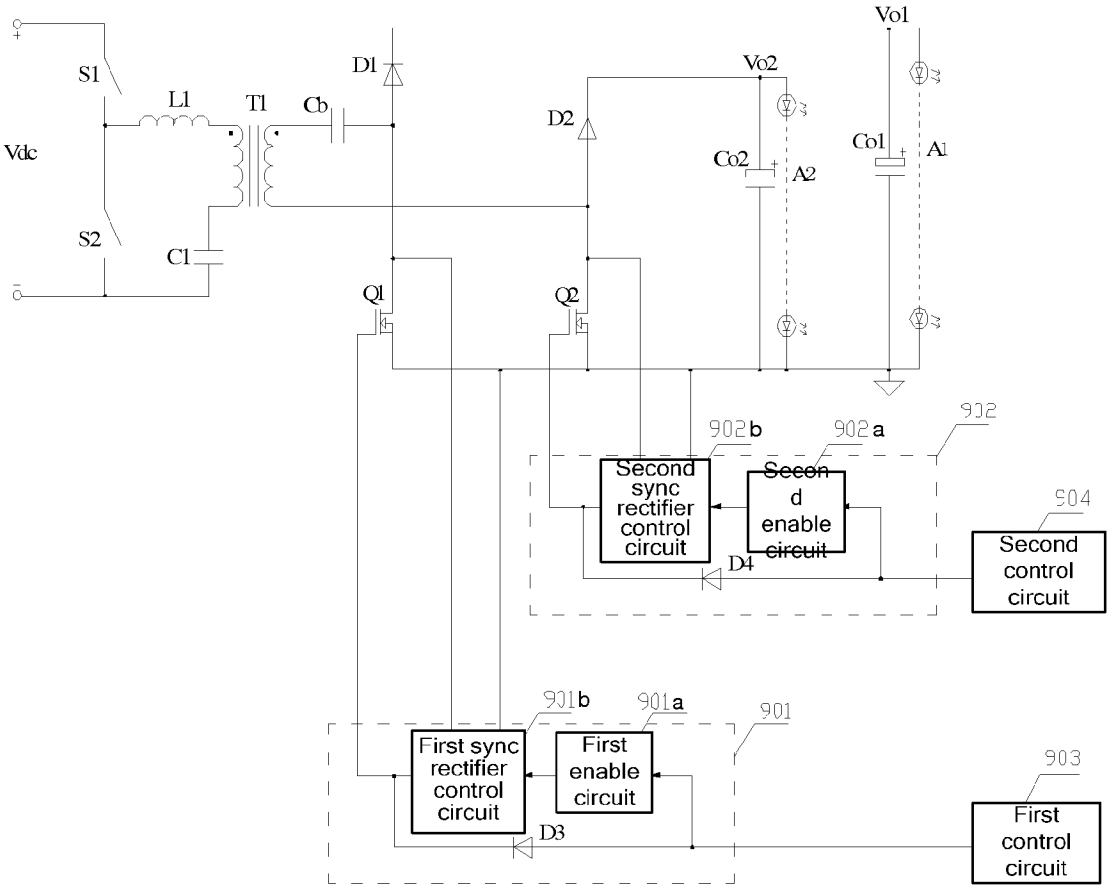
FIG. 9 is a circuit diagram of a power supply circuit for multiple LED loads according to a fifth embodiment of the invention.

A power supply circuit for multiple LED loads according to a fifth embodiment of the invention is shown in FIG. 9.

The power supply circuit of the fifth embodiment is different from that of the fourth embodiment in that the power supply circuit of the fifth embodiment further includes a first switch tube driver circuit 901, a second switch tube driver circuit 902, a first control circuit 903 and a second control circuit 904.

The first switch tube driver circuit 901 includes a first enable circuit 901*a*, the third diode D3, and a first synchronous rectifier control circuit 901*b*.

An output of the first control circuit 903 is connected to a control terminal of the first switch tube Q1 via the third diode D3; the output of the first control circuit 903 is connected to a first input of the first synchronous rectifier control circuit 901*b* via the first enable circuit 901*a*, a second input and a third input of the first synchronous rectifier control circuit 901*b* are connected to other two terminals of the first switch tube Q1 respectively, and an output of the first synchronous rectifier control circuit 901*b* is connected to the control terminal of the first switch tube Q1; and when the first LED load A1 needs to be turned off, the first control circuit 903 outputs a high level to turn on the third diode D3, and meanwhile controls the first enable circuit 901*a* to output an enable signal for stopping the first synchronous rectifier control circuit 901*b* outputting a driving signal, so as to switch on the first switch tube Q1.

The second switch tube driver circuit 902 includes a second enable circuit 902*a*, a fourth diode D4 and a second synchronous rectifier control circuit 902*b*.

An output of the second circuit 904 is connected to a control terminal of the second switch tube Q2 via the fourth diode D4; an output of the second control circuit 904 is connected to a first input of the second synchronous rectifier control circuit 902*b* via the second enable circuit 902*a*, a second input and a third input of the second synchronous rectifier control circuit 902*b* are connected to other two terminals of the second switch tube Q2 respectively, and an output of the second synchronous rectifier control circuit 902*b* is connected to the control terminal of the second switch tube Q2; and when the second LED load A2 needs to be turned off, the second control circuit 904 outputs a high level to turn on the fourth diode D4, and meanwhile controls the second enable circuit 902*a* to output an enable signal for stopping the second synchronous rectifier control circuit 902*b* outputting a driving signal, so as to switch on the second switch tube Q2.

When the circuit is in a normal state, the third diode D3 and the fourth diode D4 are both cut off, the first synchronous rectifier control circuit 901*b* detects a voltage across the first switch tube Q1 and the second synchronous rectifier control circuit 902*b* detects a voltage across the second switch tube Q2, the first enable circuit 901*a* and second enable circuit 902*a* both do not operate, and the first switch tube Q1 and the second switch tube Q2 both operate in a synchronous rectification state.

Figure 10:
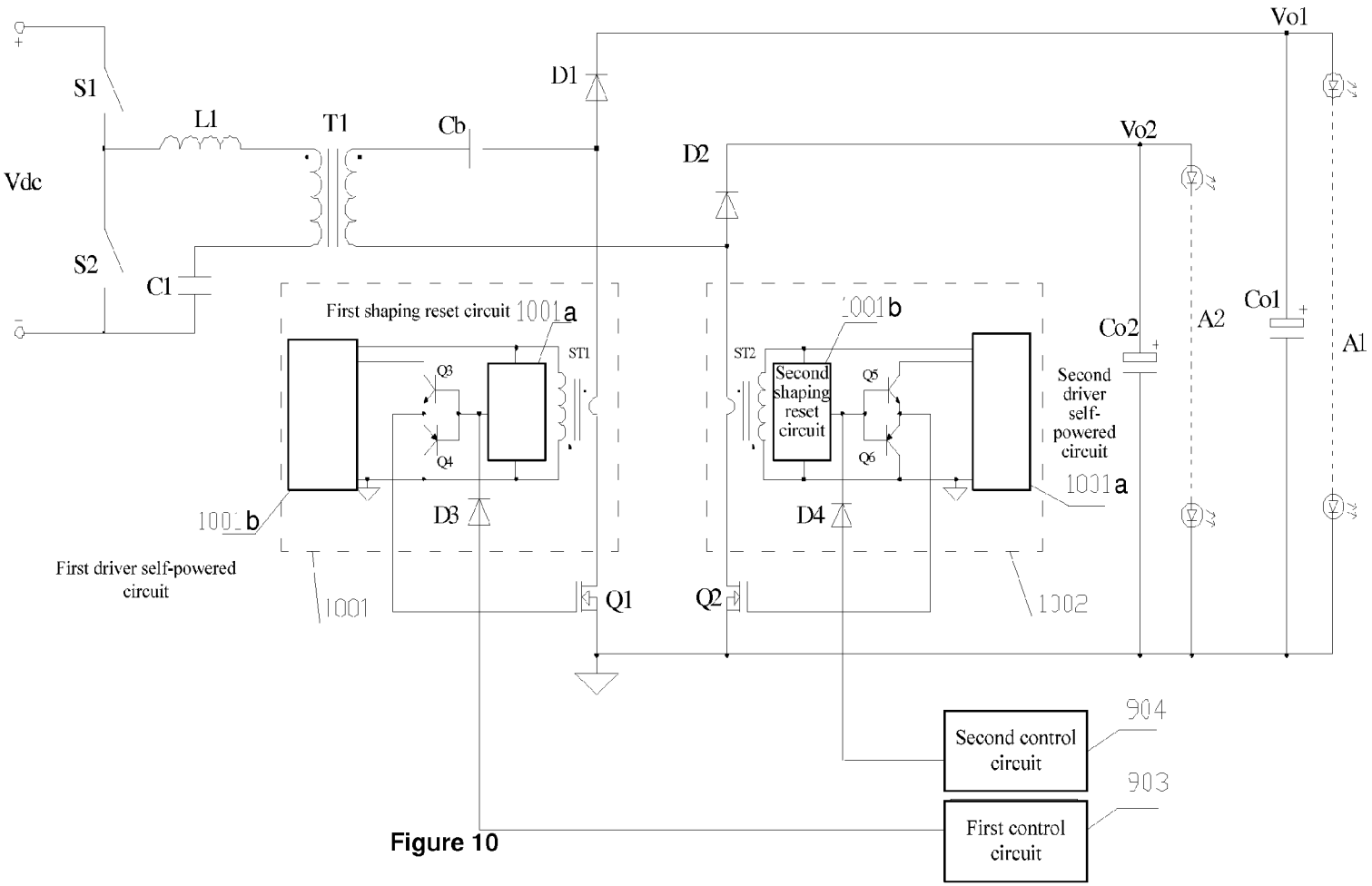
FIG. 10 is a circuit diagram of a power supply circuit for multiple LED loads according to a sixth embodiment of the invention.

It is provided another switch tube driver circuit according to an embodiment of the invention, as shown in FIG. 10, which is a circuit diagram of a power supply circuit for multiple LED loads according to a sixth embodiment of the invention.

The power supply circuit of the sixth embodiment is different from that of the fourth embodiment in that the power supply circuit of the sixth embodiment further includes a first switch tube driver circuit 1001, a second switch tube driver circuit 1002, a first control circuit 903 and a second control circuit 904.

The first switch tube driver circuit 1001 includes the third diode D3, a first current transformer ST1, a first shaping reset circuit 1001*a*, a third triode Q3, a fourth triode Q4 and a first driver self-powered circuit 1001*b*.

A primary winding of the first current transformer ST1 is connected between the first diode D1 and the first switch tube Q1, two terminals of a secondary winding of the first current transformer ST1 are respectively connected to two inputs of the first shaping reset circuit 1001*a*, and the two terminals of the secondary winding of the first current transformer ST1 are further respectively connected to two inputs of the first driver self-powered circuit 1001*b*.

The third triode Q3 and the fourth triode Q4 are connected to form a push-pull circuit, an output of the first shaping reset circuit 1001*a* is connected to the input of the push-pull circuit, and an output of the push-pull circuit is connected to a control terminal of the first switch tube Q1.

An output of the first driver self-powered circuit 1001*b* is connected to a collector of the third triode Q3, and a collector of the fourth triode Q4 is grounded.

an output of the first control circuit 903 is connected to the input of the push-pull circuit via the third diode D3; and when the first LED load A1 needs to be turned off, the first control circuit 903 outputs a high level to turn on the third diode D3, and the push-pull circuit outputs a high level to switch on the first switch tube Q1.

The second switch tube driver reset circuit 1002 includes the fourth diode D4, a second current transformer ST2, a second shaping reset circuit 1002*a*, a fifth triode Q5, a sixth triode Q6 and a second driver self-powered circuit 1002*b*.

A primary winding of the second current transformer ST2 is connected between the second diode D2 and the second switch tube Q2, two terminals of a secondary winding of the second current transformer ST2 are respectively connected to two inputs of the second shaping reset circuit 1002*a*, and the two terminals of the secondary winding of the second current transformer ST2 are further respectively connected to two inputs of the second driver self-powered circuit 1002*b*.

The fifth triode Q5 and the sixth triode Q6 are connected to form a push-pull circuit, an output of the second shaping reset circuit 1002*a* is connected to an input of the push-pull circuit, and an output of the push-pull circuit is connected to a control terminal of the second switch tube Q2; an output of the second driver self-powered circuit 1002*b* is connected to a collector of the fifth triode Q5; a collector of the sixth triode Q6 is grounded; an output of the first control circuit 903 is connected to an input of the push-pull circuit via the third diode D3; and when the second LED load A2 needs to be turned off, the second control circuit 904 outputs a high level to turn on the fourth diode D4, and the push-pull circuit outputs a high level to switch on the second switch tube Q2.

Figure 11:
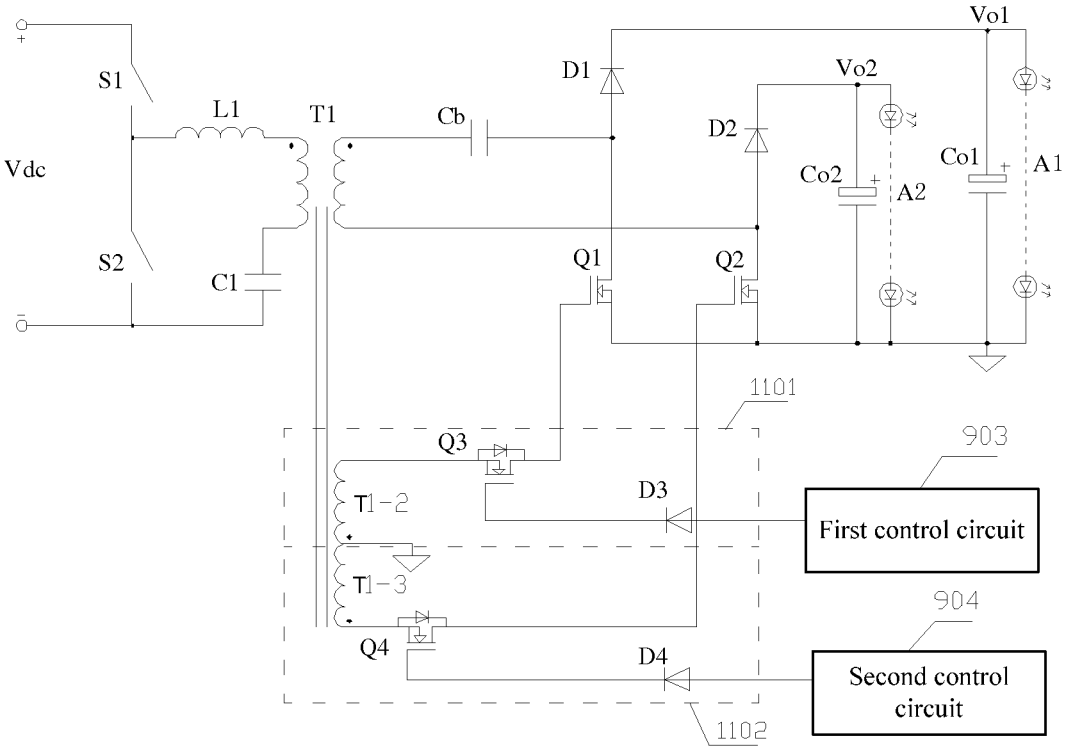
FIG. 11 is a circuit diagram of a power supply circuit for multiple LED loads according to a seventh embodiment of the invention.

It is further provided a switch tube driver circuit according to an embodiment of the invention, as shown in FIG. 11, which is a circuit diagram of a power supply circuit for multiple LED loads according to a seventh embodiment of the invention.

The power supply circuit of the seventh embodiment is different from that of the fourth embodiment in that the power supply circuit of the seventh embodiment further includes a first switch tube driver circuit 1101, a second switch tube driver circuit 1102, a first control circuit 903 and a second control circuit 904.

The first switch tube driver circuit 1101 includes the third diode D3, a first auxiliary winding T1-2 and the third switch tube Q3.

An output of the first control circuit 903 is connected to a control terminal of the third switch tube Q3 via the third diode D3; one of other two terminals of the third switch tube Q3 is connected to a control terminal of the first switch tube Q1, the other one of the other two terminals of the third switch tube Q3 is connected to one terminal of the first auxiliary winding T1-2, and the other terminal of the first auxiliary winding T1-2 is grounded.

When the first LED load A1 needs to be turned off, the first control circuit 903 outputs a low level to cut off the third diode D3 and the third switch tube Q3 and switch on the first switch tube Q1.

The second switch tube driver circuit 1102 includes a fourth diode D4, a second auxiliary winding T1-3 and a fourth switch tube Q4.

An output of the second control circuit 904 is connected to a control terminal of the fourth switch tube Q4 via the fourth diode D4; one of other two terminals of the fourth switch tube Q4 is connected to a control terminal of the second switch tube Q2, the other one of the other two terminals of the fourth switch tube Q4 is connected to one terminal of the second auxiliary winding T1-3, and the other terminal of the second auxiliary winding T1-3 is grounded; and when the second LED load A2 needs to be turned off, the second control circuit 904 outputs a low level to cut off the fourth diode D4 and the fourth switch tube Q4 and switch on the second switch tube Q2.

It is to be noted that the whole of the first auxiliary winding and the second auxiliary winding can be one winding with a grounded tap which divides the winding into the first auxiliary winding and the second auxiliary winding, as shown in FIG. 11.

Figure 12:
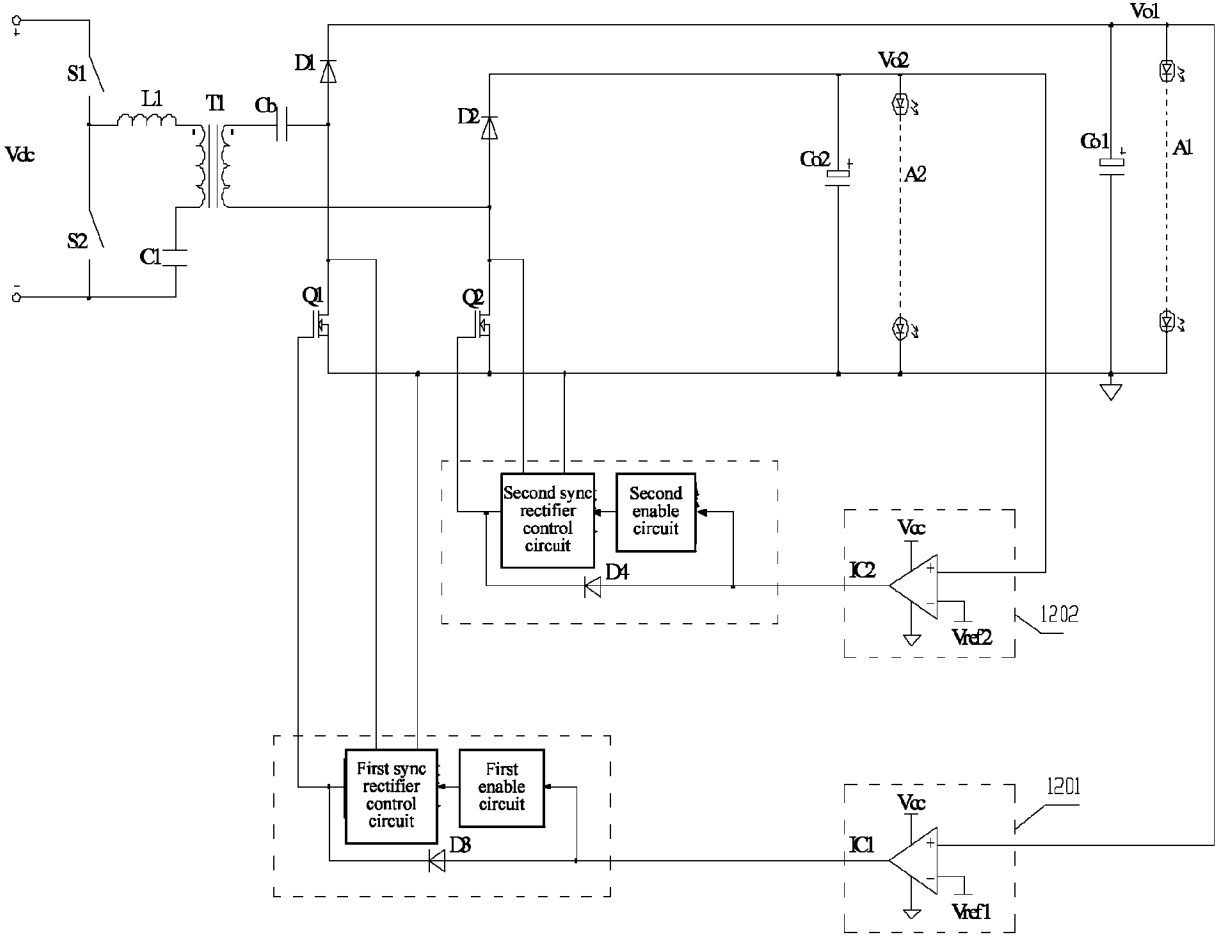
FIG. 12 is a circuit diagram of a power supply circuit for multiple LED loads according to an eighth embodiment of the invention.

It is to be noted that the first control circuit and the second control circuit of the power supply circuit for multiple LED loads in FIG. 9 to FIG. 11 have the same structure as that in FIG. 7, the description thereof is omitted, and the control circuit in FIG. 12 is described based on the control circuit in FIG. 9.

A first control circuit 1201 is configured to detect an output voltage of the first LED load A1, and switch on the first switch tube Q1 when the output voltage of the first LED load A1 is higher than the first preset voltage Vref1.

An input of the first control circuit 1201 is connected to a positive output of the first LED load A1, and an output of the first control circuit 1201 is connected to an anode of the third diode D3.

A second control circuit 1202 is configured to detect an output voltage of the second LED load A2, and switch on the second switch tube Q2 when the output voltage of the second LED load A2 is higher than the second preset voltage Vref2.

An input of the second control circuit 1202 is connected to a positive output of the second LED load A2, and an output of the second control circuit 1202 is connected to an anode of the fourth diode D4.

Preferably, the first control circuit 1201 is a first comparator IC1, and the second control circuit 1202 is a second comparator IC2.

A positive input of the first comparator IC1 is connected to a positive output of the first LED load A1, a negative input of the first comparator IC1 is connected to the first preset voltage Vref1, and an output of the first comparator IC2 is connected to an anode of the third diode D3.

A positive input of the second comparator IC2 is connected to a positive output of the second LED load A2, a negative input of the second comparator IC2 is connected to a second preset voltage Vref2, and an output of the second comparator IC2 is connected to an anode of the fourth diode D4.

It is to be noted that the first preset voltage Vref1 and the second preset voltage Vref2 may be or may be not the same.

It is to be noted that a main circuit of the power supply circuit according to the embodiments of the invention may be a LLC resonant converter circuit, a bridge circuit, an active clamp flyback circuit or a forward flyback circuit, and each of the main circuits in FIG. 9 to FIG. 12 is the LLC resonant converter circuit.

Preferably, the switch tube in the embodiments of the invention may be a MOSFET, as shown in FIG. 8 to FIG. 12.

Figure 1:
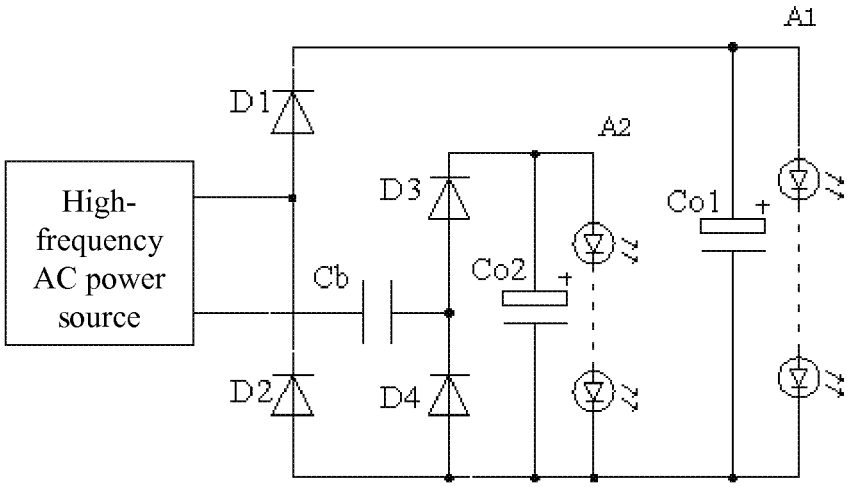
FIG. 1 is a circuit diagram of a constant driver circuit for two LED loads in the prior art.
Figure 2:
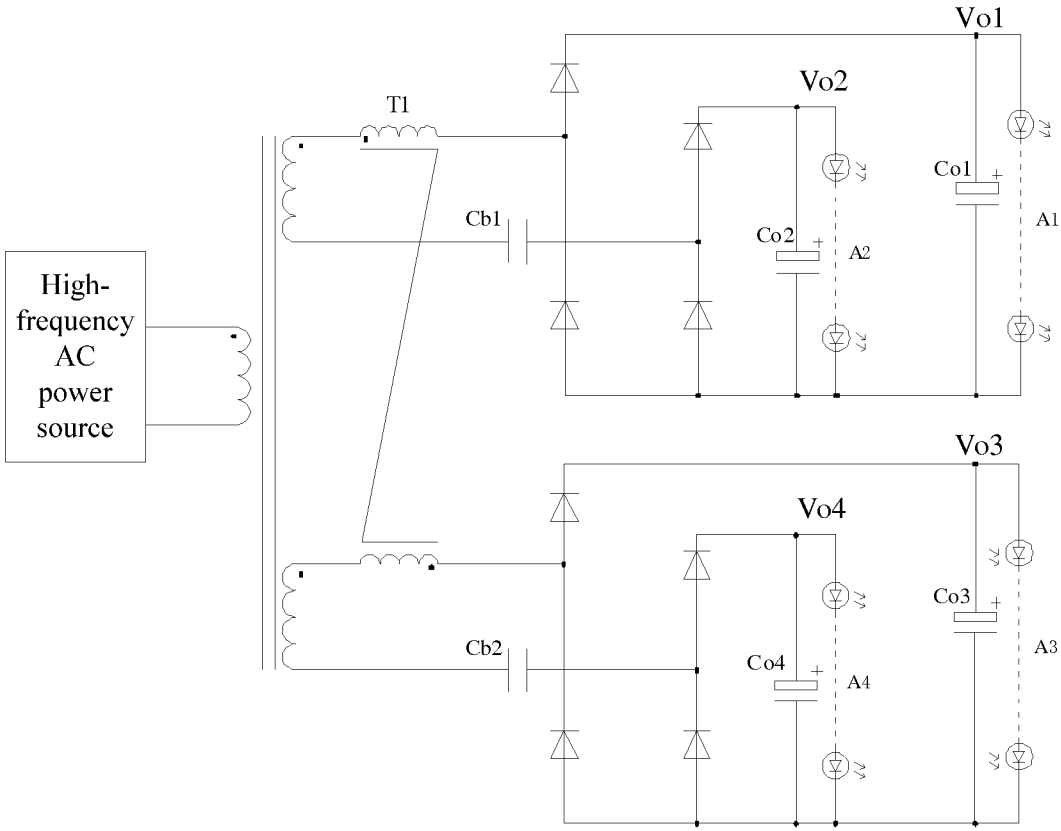
FIG. 2 is a circuit diagram of a driver circuit applicable for even number of LED loads in the prior art.
Figure 3:
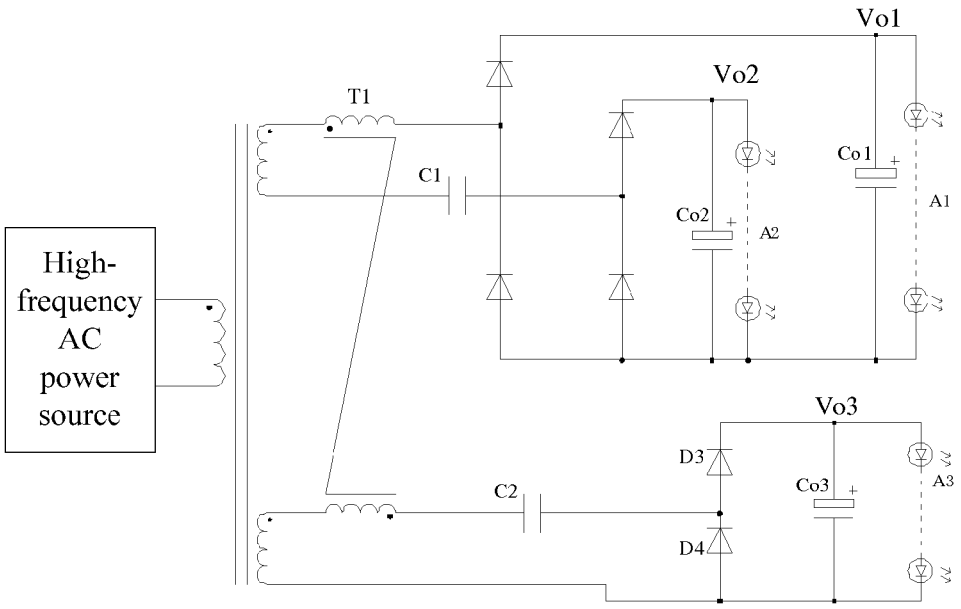
FIG. 3 is a circuit diagram of a driver circuit applicable for odd number of LED loads in the prior art.
Figure 4:
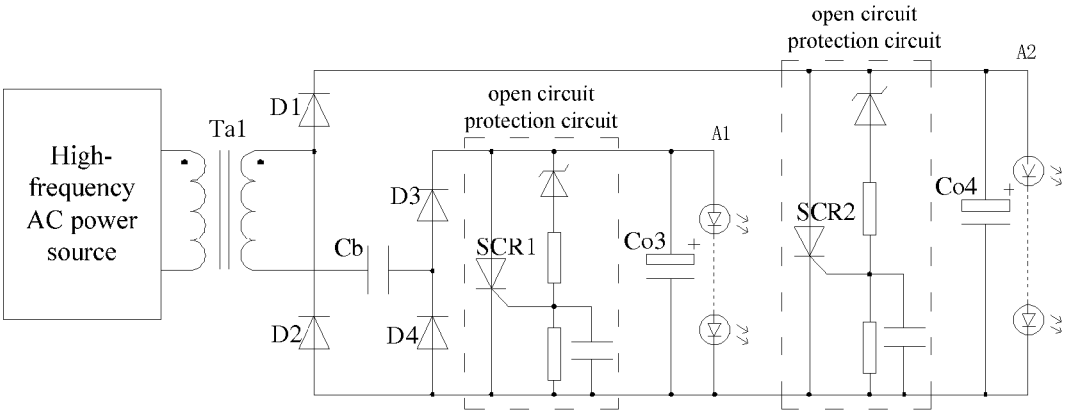
FIG. 4 is a circuit diagram of a LED driver circuit with an open circuit protection circuit in the prior art.

It is to be noted that although the above embodiments are described by taking the case of two LED loads as an example, the power supply circuit for multiple LED loads according to the embodiments of the invention may be applied to a power supply circuit for more than two LED loads, the topology thereof may be similar to the topology of the power supply circuit for even number of LED loads as shown in FIG. 2 or the topology of the power supply circuit for odd number of LED loads as shown in FIG. 3, and the description thereof is omitted.

Preferred embodiments of the present invention are disclosed above, which should not be interpreted as limiting the present invention. Numerous alternations, modifications, and equivalents can be made to the technical solutions of the present invention by those skilled in the art based on the methods and technical contents disclosed herein without deviating from the technical scope of the present invention. Therefore, any alternations, modifications, and equivalents made to the above embodiments according to the technical essential of the present invention without deviating from the scope of the present invention should fall within the scope of protection of the present invention.

What is claimed is:

1. A power supply circuit for multiple LED loads, comprising: a first filter capacitor, a second filter capacitor, a first switch tube, a second switch tube, a first rectifier branch and a second rectifier branch, wherein:

inputs of the first rectifier branch and inputs of the second rectifier branch are connected to a high-frequency AC power source;

a first input of the first rectifier branch, a first diode, a first LED load, a fourth diode and a first capacitor are sequentially connected in series to a second input of the first rectifier branch;

a second input of the second rectifier branch, the first capacitor, a third diode, a second LED load and a second diode are sequentially connected in series to a first input of the second rectifier branch;

the first input of the first rectifier branch is connected to the first input of the second rectifier branch, and the second input of the first rectifier branch is connected to the second input of the second rectifier branch;

the first filter capacitor is connected in parallel to the first LED load, and the second filter capacitor is connected in parallel to the second LED load;

the first switch tube is connected in parallel to the second diode, and when the first LED load needs to be turned off, the first switch tube is switched on; and the second switch tube is connected in parallel to the fourth diode, and when the second LED load needs to be turned off, the second switch tube is switched on.

2. The power supply circuit for multiple LED loads according to claim 1, further comprising a first control circuit and a second control circuit, wherein:

the first control circuit is configured to detect an output voltage of the first LED load, and switch on the first switch tube when the output voltage of the first LED load is higher than a first preset voltage; and the second control circuit is configured to detect an output voltage of the second LED load, and switch on the second switch tube when the output voltage of the second LED load is higher than a second preset voltage.

3. The power supply circuit for multiple LED loads according to claim 2, wherein the first control circuit is a first comparator, and the second control circuit is a second comparator;

a positive input of the first comparator is connected to a positive output of the first LED load, a negative input of the first comparator is connected to the first preset voltage, and an output of the first comparator is connected to a control terminal of the first switch tube; and a positive input of the second comparator is connected to a positive output of the second LED load, a negative input of second comparator is connected to the second preset voltage, and an output of the second comparator is connected to a control terminal of the second switch tube.

4. The power supply circuit for multiple LED loads according to claim 1, wherein a main circuit of the power supply circuit is a LLC resonant converter circuit, a bridge circuit, an active clamp flyback circuit or a forward flyback circuit.

5. The power supply circuit for multiple LED loads according to claim 1, further comprising a first switch tube driver circuit, a second switch tube driver circuit, a first control circuit and a second control circuit, wherein:

the first switch tube driver circuit comprises a fifth diode, a first auxiliary winding and a third switch tube; an output of the first control circuit is connected to a control terminal of the third switch tube via the fifth diode; one of other two terminals of the third switch tube is connected to a control terminal of the first switch tube, the other one of the other two terminals of the third switch tube is connected to one terminal of the first auxiliary winding, and the other terminal of the first auxiliary winding is grounded; and when the first LED load needs to be turned off, the first control circuit outputs a low level to cut off the fifth diode and the third switch tube and switch on the first switch tube; and the second switch tube driver circuit comprises a sixth diode, a second auxiliary winding and a fourth switch tube; an output of the second control circuit is connected to a control terminal of the fourth switch tube via the sixth diode; one of other two terminals of the fourth switch tube is connected to a control terminal of the second switch tube, the other one of the other two terminals of the fourth switch tube is connected to one terminal of the second auxiliary winding, and the other terminal of the second auxiliary winding is grounded; and when the second LED load needs to be turned off, the second control circuit outputs a low level to cut off the sixth diode and the fourth switch tube and switch on the second switch tube.

6. The power supply circuit for multiple LED loads according to claim 5, wherein the first control circuit is configured to detect an output voltage of the first LED load, and switch on the first switch tube when the output voltage of the first LED load is higher than a first preset voltage; and the second control circuit is configured to detect an output voltage of the second LED load, and switch on the second switch tube when the output voltage of the second LED load is higher than a second preset voltage.

7. The power supply circuit for multiple LED loads according to claim 1, further comprising a first switch tube driver circuit, a second switch tube driver circuit, a first control circuit and a second control circuit, wherein:

the first switch tube driver circuit comprises a first enable circuit, a fifth diode and a first synchronous rectifier control circuit; an output of the first control circuit is connected to a control terminal of the first switch tube via the fifth diode; the output of the first control circuit is connected to a first input of the first synchronous rectifier control circuit via the first enable circuit, a second input and a third input of the first synchronous rectifier control circuit are connected to other two terminals of the first switch tube respectively, and an output of the first synchronous rectifier control circuit is connected to the control terminal of the first switch tube; and when the first LED load needs to be turned off, the first control circuit outputs a high level to turn on the fifth diode, and meanwhile controls the first enable circuit to output an enable signal for stopping the first synchronous rectifier control circuit outputting a driving signal, so as to switch on the first switch tube;

the second switch tube driver circuit comprises a second enable circuit, a sixth diode, and a second synchronous rectifier control circuit; an output of the second control circuit is connected to a control terminal of the second switch tube via the sixth diode; the output of the second control circuit is connected to a first input of the second synchronous rectifier control circuit via the second enable circuit, a second input and a third input of the second synchronous rectifier control circuit are connected to other two terminals of the second switch tube respectively, and an output of the second synchronous rectifier control circuit is connected to the control terminal of the second switch tube; and when the second LED load needs to be turned off, the second control circuit outputs a high level to turn on the sixth diode, and meanwhile controls the second enable circuit to output an enable signal for stopping the second synchronous rectifier control circuit outputting a driving signal, so as to switch on the second switch tube.

8. The power supply circuit for multiple LED loads according to claim 7, wherein the first control circuit is configured to detect an output voltage of the first LED load, and switch on the first switch tube when the output voltage of the first LED load is higher than a first preset voltage; and the second control circuit is configured to detect an output voltage of the second LED load, and switch on the second switch tube when the output voltage of the second LED load is higher than a second preset voltage.

9. The power supply circuit for multiple LED loads according to claim 8, wherein the first control circuit is a first comparator, and the second control circuit is a second comparator;

a positive input of the first comparator is connected to a positive output of the first LED load, a negative input of the first comparator is connected to the first preset voltage, and an output of the first comparator is connected to an anode of the fifth diode; and a positive input of the second comparator is connected to a positive output of the second LED load, a negative input of the second comparator is connected to the second preset voltage, and an output of the second comparator is connected to an anode of the sixth diode.

10. The power supply circuit for multiple LED loads according to claim 1, further comprising a first switch tube driver circuit, a second switch tube driver circuit, a first control circuit and a second control circuit, wherein:

the first switch tube driver circuit comprises a fifth diode, a first current transformer, a first shaping reset circuit, a third triode, a fourth triode and a first driver self-powered circuit; a primary winding of the first current transformer is connected between the first diode and the first switch tube, two terminals of a secondary winding of the first current transformer are respectively connected to two inputs of the first shaping reset circuit, and the two terminals of the secondary winding of the first current transformer are further respectively connected to two inputs of the first driver self-powered circuit; the third triode and the fourth triode are connected to form a push-pull circuit, an output of the first shaping reset circuit is connected to an input of the push-pull circuit, and an output of the push-pull circuit is connected to a control terminal of the first switch tube; an output of the first driver self-powered circuit is connected to a collector of the third triode; a collector of the fourth triode is grounded; an output of the first control circuit is connected to the input of the push-pull circuit via the fifth diode; and when the first LED load needs to be turned off, the first control circuit outputs a high level to turn on the fifth diode, and the push-pull circuit outputs a high level to switch on the first switch tube; and the second switch tube driver circuit comprises a sixth diode, a second current transformer, a second shaping reset circuit, a fifth triode, a sixth triode and a second driver self-powered circuit; a primary winding of the second current transformer is connected between the third diode and the second switch tube, two terminals of a secondary winding of the second current transformer are respectively connected to two inputs of the second shaping reset circuit, and the two terminals of secondary winding of the second current transformer are further respectively connected to two inputs of the second driver self-powered circuit; the fifth triode and sixth triode are connected to form a push-pull circuit, an output of the second shaping reset circuit is connected to an input of the push-pull circuit, and an output of the push-pull circuit is connected to a control terminal of the second switch tube; an output of the second driver self-powered circuit is connected to a collector of the fifth triode; a collector of sixth triode is grounded; an output of the second control circuit is connected to the input of the push-pull circuit via the sixth diode; and when the second LED load needs to be turned off, the second control circuit outputs a high level to turn on the sixth diode, and the push-pull circuit outputs a high level to switch on the second switch tube.

11. The power supply circuit for multiple LED loads according to claim 10, wherein the first control circuit is configured to detect an output voltage of the first LED load, and switch on the first switch tube when the output voltage of the first LED load is higher than a first preset voltage; and the second control circuit is configured to detect an output voltage of the second LED load, and switch on the second switch tube when the output voltage of the second LED load is higher than a second preset voltage.

12. The power supply circuit for multiple LED loads according to claim 11, wherein the first control circuit is a first comparator, and the second control circuit is a second comparator;

a positive input of the first comparator is connected to a positive output of the first LED load, a negative input of the first comparator is connected to the first preset voltage, and an output of the first comparator is connected to an anode of the fifth diode; and a positive input of the second comparator is connected to a positive output of the second LED load, a negative input of the second comparator is connected to the second preset voltage, and an output of the second comparator is connected to an anode of the sixth diode.

* * * * *